US010856653B2

(12) United States Patent
Wang

(10) Patent No.: US 10,856,653 B2
(45) Date of Patent: Dec. 8, 2020

(54) LIGHT-EMITTING DESK OR STOOL

(71) Applicant: Quanzhou Viition Gifts Co., Ltd., Fujian (CN)

(72) Inventor: Peijun Wang, Fujian (CN)

( * ) Notice: Subject to any disclaimer, the term of this patent is extended or adjusted under 35 U.S.C. 154(b) by 0 days.

(21) Appl. No.: 16/420,181

(22) Filed: May 23, 2019

(65) Prior Publication Data

US 2019/0357669 A1 Nov. 28, 2019

(30) Foreign Application Priority Data

May 23, 2018 (CN) ..... 2018 1 0501946

(51) Int. Cl.

| | |
|---|---|
| ***A47B 13/12*** | (2006.01) |
| ***A47C 7/72*** | (2006.01) |
| ***F21S 4/00*** | (2016.01) |
| ***F21S 9/03*** | (2006.01) |
| ***F21V 23/02*** | (2006.01) |
| *F21Y 115/10* | (2016.01) |

(52) U.S. Cl.

CPC ..... *A47B 13/12* (2013.01); *A47C 7/725* (2013.01); *F21S 4/00* (2013.01); *F21S 9/032* (2013.01); *F21V 23/02* (2013.01); *A47B 2220/0077* (2013.01); *F21Y 2115/10* (2016.08)

(58) Field of Classification Search

CPC . A47B 13/12; A47B 2220/0077; A47B 13/02; A47C 7/725; A47C 4/14; A47C 4/24; A47C 9/00; F21S 4/00; F21S 9/032; F21S 9/037; F21V 23/02; F21V 33/0012; F21Y 2115/10; F21W 2131/301

See application file for complete search history.

(56) References Cited

U.S. PATENT DOCUMENTS

| | | | | |
|---|---|---|---|---|
| 2011/0265694 | A1* | 11/2011 | Portis | A45B 3/00 108/50.12 |
| 2014/0009103 | A1* | 1/2014 | Nita | H02J 7/35 320/101 |
| 2014/0217954 | A1* | 8/2014 | Wilde | H02J 7/35 320/101 |
| 2015/0250300 | A1* | 9/2015 | Watts | A47B 3/0818 108/18 |
| 2017/0063148 | A1* | 3/2017 | Wang | H02S 40/38 |
| 2019/0167826 | A1* | 6/2019 | Winslow | A61N 5/0624 |

* cited by examiner

*Primary Examiner* — Kevin Quarterman

(74) *Attorney, Agent, or Firm* — Prakash Nama; Global IP Services, PLLC

(57) ABSTRACT

A light-emitting desk or stool, having a frame and a support portion mounted on the frame; the support portion is a hollowed light-emitting box having a mounting seat and a transparent cover mounted on the mounting seat; a cavity is formed between the mounting seat and the transparent cover; light-emitting bodies are provided within the cavity. Lights emitted by the light-emitting bodies can illuminate through the transparent cover to provide lighting effect. Also, the lights emitted by the light-emitting bodies can pass through hollowed portions provided on the mounting seat, thereby projecting a pattern defined by the hollowed portions to the external environment, and hence enhancing the lighting effect as well as providing aesthetic effect. The pattern defined by the hollowed portions can be flexibly designed according to personal preference or practical need.

11 Claims, 14 Drawing Sheets

LIGHT-EMITTING DESK OR STOOL

BACKGROUND OF THE INVENTION

The present invention relates to a kind of desk and stool, and more specifically relates to a light-emitting desk or stool.

Nowadays, the designs of foldable desks or foldable stools are more or less the same without any light-emitting function. When used at night time, a light-emitting tool has to be additionally used to facilitate users' activities.

In view of the above, the inventor has invented a light-emitting desk or stool having a novel structure.

BRIEF SUMMARY OF THE INVENTION

It is an object of the present invention to provide a light-emitting desk or stool having a novel structure.

The present invention is achieved as follows:

1. A light-emitting desk or stool, comprising a frame and a support portion mounted on the frame; wherein the support portion is a hollowed light-emitting box, comprising a mounting seat and a transparent cover mounted on the mounting seat; a cavity is formed between the mounting seat and the transparent cover; light-emitting bodies are provided within the cavity.

In view of the above technical solutions, the light-emitting desk or stool of the present invention has the following beneficial effects: lights emitted by the light-emitting bodies can illuminate through the transparent cover to provide lighting effect. Also, the lights emitted by the light-emitting bodies can pass through hollowed portions provided on the mounting seat, thereby projecting a pattern defined by the hollowed portions to the external environment, and hence enhancing the lighting effect as well as providing aesthetic effect. The pattern defined by the hollowed portions can be flexibly designed according to personal preference or practical need.

2. The mounting seat comprises a base board and a side board connected to a periphery of the base board enclosing the base board, wherein the base board and/or the side board is a hollowed base board and a hollowed side board respectively; hollowed portions that allow light permeation are provided on the hollowed base board and the hollowed side board; the transparent cover is a glass cover, or the transparent cover is a hollowed cover having hollowed portions; the light-emitting bodies are light strips; the light strips are mounted to an inner surface of the base board, and/or to an inner surface of the side board.

3. The light strips are mounted to the inner surface of the base board; a fixing aid is provided on the inner surface of the base board to facilitate arrangement of the light strips.

4. The fixing aid is a fixing disc 44 having a spiral shape, or the fixing aid comprises a group of concentric circular rings, or the fixing aid comprises rods, or the fixing aid comprises parts of the base board 11 being bended up.

5. The hollowed light-emitting box is provided with a power source module to provide working power for the light strips; the power source module is a solar power assembly; the solar power assembly comprises a solar panel movably adjustable in position to be unfolded to a position below sunlight to absorb the sunlight, and also capable of being folded for storage.

6. The solar power assembly uses a battery box; the battery box comprises a battery box body and the solar panel; the solar panel is disposed on the battery box body; the battery box body is fixed to the side board of the mounting seat, or fixed to the base board of the mounting seat near to a periphery of the base board.

Power generation by solar energy conserves energy, and is convenient and environmentally friendly.

7. The battery box body comprises a battery box shell; a storage battery and a control circuit that controls power output and recharge are disposed inside the battery box shell; a side wall of the battery box shell is provided with a DC plug or a DC port; the DC plug or the DC port is provided with a water-proof stopper; the storage battery and the control circuit are electrically connected to each other bidirectionally; the DC plug or the DC port is electrically connected to an input end of the control circuit, and the solar panel is connected to the input end of the control circuit; an output end of the control circuit is electrically connected to the light strips via a control button; the control button is sleeved with a control button water-proof cap.

8. Support blocks are provided on the base board around the periphery of the base board to support the transparent cover; the transparent cover is supported on the support blocks, or the transparent cover is supported on the support blocks while anti-shock gasket is provided between each of the support blocks and the transparent cover.

9. The transparent cover is fixed to the hollowed light-emitting box via fastening components; slots are provided at an upper part of the hollowed side board; the slots run through an upper periphery of the hollowed side board; the slots are fitted with fasteners respectively; each of the fasteners comprises a press portion and a lock portion perpendicular to each other; the press portion presses tightly against a periphery of an upper surface of the transparent cover; the lock portion locks with the hollowed side board; a shape and size of the lock portion of each of the fasteners match with a corresponding slot; the lock portion of each of the fasteners is mounted into a corresponding slot.

10. The side board is a hollowed side board; both the transparent cover and the base board have a circular shape; correspondingly, the hollowed side board has a circular ring shape; foldable fixing pieces are distributed around an upper periphery of the hollowed side board along a circumferential direction of the hollowed side board; the foldable fixing pieces are soft and durable to repeated bending; the transparent cover is fixed to the hollowed side board via the foldable fixing pieces.

| | |
|---|---|
| 1: mounting seat | 11: hollowed base board |
| 12: hollowed side board | 13: foldable fixing pieces |
| 14: iron plates | 15: support blocks |
| 151: slots | 152: fasteners |
| 153: screws | 154: first threaded holes |
| 155: second threaded holes | 2: glass cover |
| 3: LED strip lights | 4: fixing aid |
| 41: fixing rings | 42: longitudinal rod |
| 43: lateral rod | 44: fixing disc |
| 51: protective shell | 52: solar panel |
| 6: mounting block | 61: second rotational shaft |
| 71: first leg | 72: second leg |
| 73: coupling frame | 74: first pin |
| 75: second pin | 76: fixing component |
| 8: battery box | 81: battery box shell |
| 82: battery box cover | 83: solar panel frame |
| 84: storage battery | 85: PCB |
| 86: DC plug or DC port | 87: water-proof stopper |
| 88: control button | 89: control button water-proof cap |
| 91: inwardly recessed gear | 92: protruded gear |
| 16: anti-shock gasket | 801: installation hole |
| 802: buckles | 803: grooves |
| 804: first screw holes | 805: tightening strips |
| 806: second screw holes | 91: outer petal |
| 92: inner petal | 156: step |
| 121: mounting platform | |

DETAILED DESCRIPTION OF THE INVENTION

In order to further explain the technical solutions provided by the present invention, the present invention will be further described in detail below with reference to some embodiments.

Embodiment 1

Figure 1:
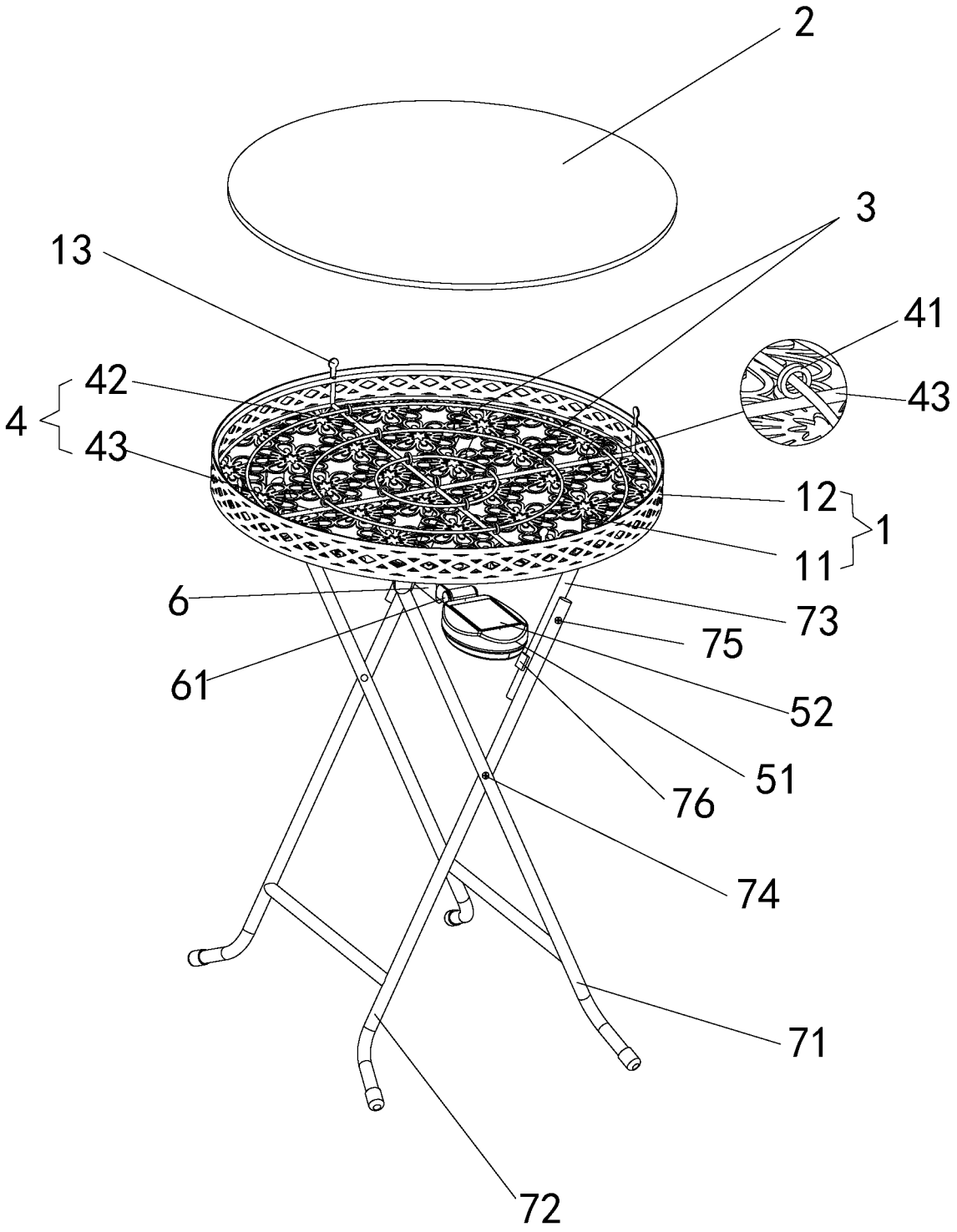
FIG. 1 is a schematic structural view of embodiment 1 of the present invention.

As shown in FIG. 1, a light-emitting desk or stool of the present invention mainly comprises a frame and a support portion mounted on the frame.

The support portion is a hollowed light-emitting box, comprising a mounting seat 1 and a transparent cover removably mounted on the mounting seat 1; the transparent cover is preferably a glass cover 2 which allow light permeation. Of course, where light can permeate through the hollowed portions. The transparent cover can be a sealed cover or hollowed cover; preferably, the transparent cover is a sealed cover so as to protect electronic components inside the hollowed light-emitting box from wind and rain, so as to increase the service life of the product.

The mounting seat 1 comprises a base board and a side board connected to a periphery of the base board enclosing the base board, wherein the base board and/or the side board is a hollowed base board 11 and a hollowed side board 12 respectively; hollowed portions for light permeation are provided on the hollowed base board 11 and the hollowed side board 12; in other words, at least one of the base board and the side board is provided with hollowed portions. The description below describes the situation where both the base board and the side board are provided with the hollowed portions.

Both the glass cover 2 and the hollowed base board 11 have a circular shape; correspondingly, the hollowed side board 12 has a circular ring shape. The shape and size of the glass cover 2 match with the circular ring shape of the hollowed side board 12; foldable fixing pieces 13 are evenly distributed around an upper periphery of the hollowed side board 12 along a circumferential direction of the hollowed side board 12; by definition, the foldable fixing pieces 13 are foldable, and they are soft and durable to repeated bending. The foldable fixing pieces 13 can be those available in the prior art like those used at the back of a photo/picture mounting frame. A flange is provided around an inner side wall of the hollowed side board 12 near to an upper edge of the hollowed side board 12 to support the glass cover 2. The glass cover 2 is embedded within the hollowed side board 12, and a position where the glass cover 2 is embedded within the hollowed side board 12 is limited and defined by the flange. By bending the foldable fixing pieces 13, bended parts of the foldable fixing pieces 13 are tightly attached to the glass cover 2. As such, by using the foldable fixing pieces 13 and the flange, the glass cover 2 is locked to align with the upper edge of the hollowed side board 12.

A cavity is formed between the hollowed base board 11 and the glass cover 2. Light-emitting bodies are provided within the cavity. The light-emitting bodies can be strings of light beads or strip lights etc, and preferably LED strip lights 3. The LED strip lights 3 are mounted to an inner surface of the hollowed base board 11, wherein the inner surface of the hollowed base board 11 is a surface of the hollowed base board 11 facing towards the glass cover 2, as opposed to an outer surface of the hollowed base board 11 which is a surface opposite to the inner surface.

A power source module is provided on the outer surface of the hollowed base board 11 proximal to a periphery of the outer surface of the hollowed base board 11 to provide working power for the LED strip lights 3. The power source module is preferably a solar power assembly. The solar power assembly comprises a protective shell 51, a solar panel 52, a storage battery and a control circuit that controls power output and recharge. The solar panel 52 is fixedly provided on an outer surface of the protective shell 51. During recharging, the solar panel 52 faces towards the sun. The storage battery and the control circuit are positioned inside the protective shell 51. The storage battery and the control circuit are connected bidirectionally. The solar panel 52 is connected to an input end of the control circuit. An output end of the control circuit is electrically connected to the LED strip lights 3 through a control button.

The solar power assembly is mounted to the outer surface of the hollowed base board 11 near to the periphery of the outer surface of the hollowed base board 11 via a mounting block 6. A first rotational shaft (not shown in the figures) is provided on the mounting block 6 along a direction perpendicular to a horizontal mounting surface of the support portion. One end of the mounting block 6 hinges with the hollowed base board 11 via the first rotational shaft. Another end of the mounting block 6 hinges with the protective cover 51 via a second rotational shaft 61; the second rotational shaft 61 is perpendicular to the first rotational shaft. As such, when the solar power assembly is positioned outside the periphery of the support portion, the solar power assembly can be rotated along an axial direction of the second rotational shaft 61 to adjust an angle of the solar panel 52, or the solar power assembly can be rotated to a position perpendicular to the horizontal mounting surface of the support portion, so as to reduce space being occupied for easier storage. Further, the solar power assembly together with the mounting block 6 can be rotated along an axial direction of the first rotational shaft, so that the solar power assembly rotates to a position below the hollowed base board 11 to further reduce the space being occupied.

More preferably, the frame is a foldable frame. An exemplary embodiment of a foldable frame will be described below. The foldable frame used by the present invention is a common foldable frame in the prior art used with a foldable table to achieve folding. In the present embodiment, the foldable frame comprises a first leg 71, a second leg 72 and a coupling frame 73; a middle part of the first leg 71 and the second leg 72 are hinged together and are foldable with respect to each other via a first pin 74; the first leg 71 and the second leg 72 cross each other, with the first pin being a point of intersection. A top part of the second leg 72 and the coupling frame 73 are hinged together and are foldable with respect to each other via a second pin 75. A surface of a lower part of the coupling frame 73 facing to the first leg 71 is provided with a fixing component 76 to couple the coupling frame 73 and the second leg 72 such that the coupling frame 73 and the second leg 72 are fixed in position so as to stably support the support portion when the desk or stool is unfolded. A top part of the first leg 71 and a top part of the coupling frame 73 are both hinged onto the hollowed base board 11. Accordingly, folding effect can be achieved.

It should be noted that, apart from strip lights, the light-emitting bodies of the present invention can also be light-emitting bodies which give out fluorescent effects, for example, light-emitting bodies made of acrylic materials.

Embodiment 2

Figure 2:
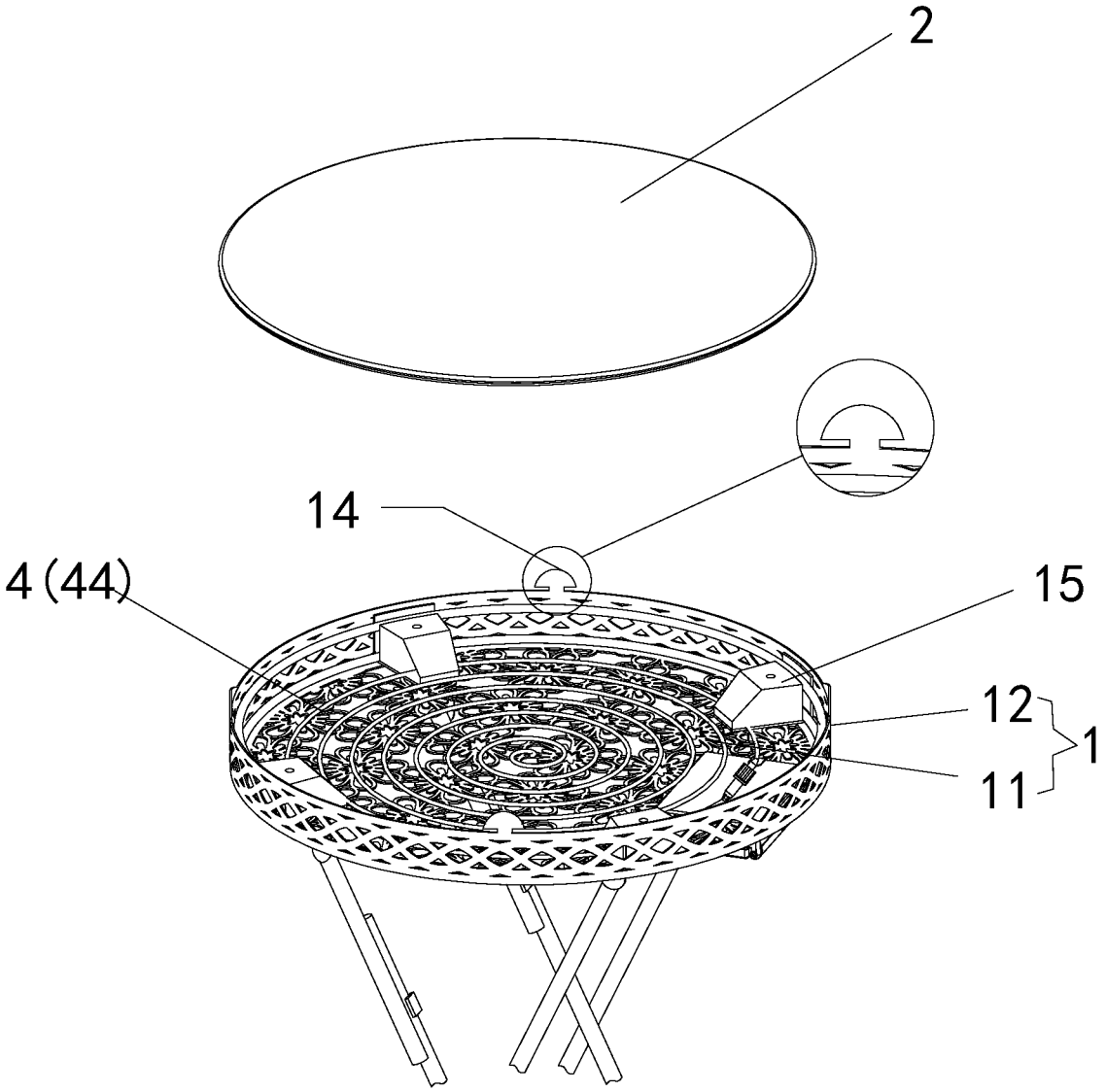
FIG. 2 is a schematic structural view of embodiment 2 of the present invention.

As shown in FIG. 2, a light-emitting desk or stool of the present invention mainly comprises a frame and a support portion mounted on the frame.

The support portion is a hollowed light-emitting box, comprising a mounting seat 1 and a transparent cover removably mounted on the mounting seat 1; the transparent cover is preferably a glass cover 2 which allow light permeation. Of course, the transparent cover may be a hollowed cover having a hollowed portion, where light can permeate through the hollowed portion. The transparent cover can be a sealed cover or hollowed cover; preferably, the transparent cover is a sealed cover so as to protect electronic components inside the hollowed light-emitting box from wind and rain, so as to increase the service life of the product.

The mounting seat 1 comprises a base board and a side board connected to a periphery of the base board enclosing the base board, wherein the base board and/or the side board is a hollowed base board 11 and a hollowed side board 12 respectively; hollowed portions for light permeation are provided on the hollowed base board 11 and the hollowed side board 12; the description below describes the situation where both the base board and the side board are provided with the hollowed portions.

Both the glass cover 2 and the hollowed base board 11 have a circular shape; correspondingly, the hollowed side board 12 has a circular ring shape. The shape and size of the glass cover 2 match with the circular ring shape of the hollowed side board 12; foldable fixing pieces are evenly distributed around an upper periphery of the hollowed side board 12 along a circumferential direction of the hollowed side board 12; by definition, the foldable fixing pieces 13 are foldable, and they are soft and durable to repeated bending. The foldable fixing pieces 13 can be those available in the prior art like those used at the back of a photo/picture mounting frame. Preferably, the foldable fixing pieces 13 are iron plates 14; each of the iron plates 14 comprises a connecting portion fixedly connected to the upper periphery of the hollowed side board 12, and a bending portion which can be bent and pressed. The bending portion has a semi-circular shape to facilitate bending and pressing.

Support blocks 15 are provided on the hollowed base board 11 around a periphery of the hollowed base board 11 to support the glass cover 2. Preferably, there are four support blocks 15 provided evenly around a circumferential direction of the hollowed base board 11. The support blocks 15 are fixed on the hollowed base board 11 via screws, and also abut against the hollowed side board 12. The glass cover 2 is stably supported on the support blocks 15; a distance between a top surface of the each of the support blocks 15 and the upper periphery of the hollowed side board 12 is equal to a thickness of the glass cover 2. During use, the glass cover 2 is placed on the support blocks 15, and then the bending portions of the iron plates 14 are bent to attach to the glass cover 2. By using the iron plates, the glass cover 2 is locked in position within the hollowed side board 12. The support blocks 15 have stabling and supporting functions, and can also reduce shock, so as to prevent breakage of the glass cover 2.

A cavity is formed between the hollowed base board 11 and the glass cover 2. Light-emitting bodies are provided within the cavity. The light emitting bodies can be strings of light beads or strip lights etc, and preferably LED strip lights 3. The LED strip lights 3 are mounted to an inner surface of the hollowed base board 11, wherein the inner surface of the hollowed base board 11 is a surface of the hollowed base board 11 facing towards the glass cover 2, as opposed to an outer surface of the hollowed base board 11 which is a surface opposite to the inner surface.

According to a first preferred specific arrangement of the LED strip lights, the inner surface of the hollowed base board 11 is provided with a fixing aid 4 to facilitate the arrangement of the LED strip lights. In the present embodiment, the fixing aid 4 is a fixing disc 44 which allows the LED strip lights to wind around. The fixing disc 44 is arranged on the inner surface of the hollowed base board 11 in a spiral shape. The fixing disc 44 can be made by bending iron wires. The LED strip lights wind around the fixing disc 44.

Hollowed portions are provided on the hollowed side board 12 to allow light permeation. All hollowed portions together define a pattern. Lights emitted by the LED strip lights illuminate from inside to outside of the hollowed side board 12 via the hollowed portions. Also, the lights emitted by the LED strip lights also illuminate through the glass cover 2. The lights illuminated out of the hollowed portions of the hollowed side board 12 are projected to the floor or on the wall so that the pattern defined by the hollowed portions can be seen. As such, a good visual effect is achieved in that not only lighting is provided, but a pattern is generated for visual appreciation.

A power source module is provided on the outer surface of the hollowed base board 11 proximal to a periphery of the outer surface of the hollowed base board 11 to provide working power for the LED strip lights 3. The power source module is preferably a solar power assembly.

Preferably, the frame is a foldable frame. The foldable frame used by the present invention is a foldable frame available in the market commonly used with a foldable desk to achieve folding effect. Hence, the foldable frame will not be described in detail herein.

It should be noted that, structures and positions of the support blocks 15 are preferably designed to support the transparent cover while not obstructing the lights to illuminate out of the hollowed portions to project the entire pattern defined by the hollowed portions.

Embodiment 3

Figure 3:
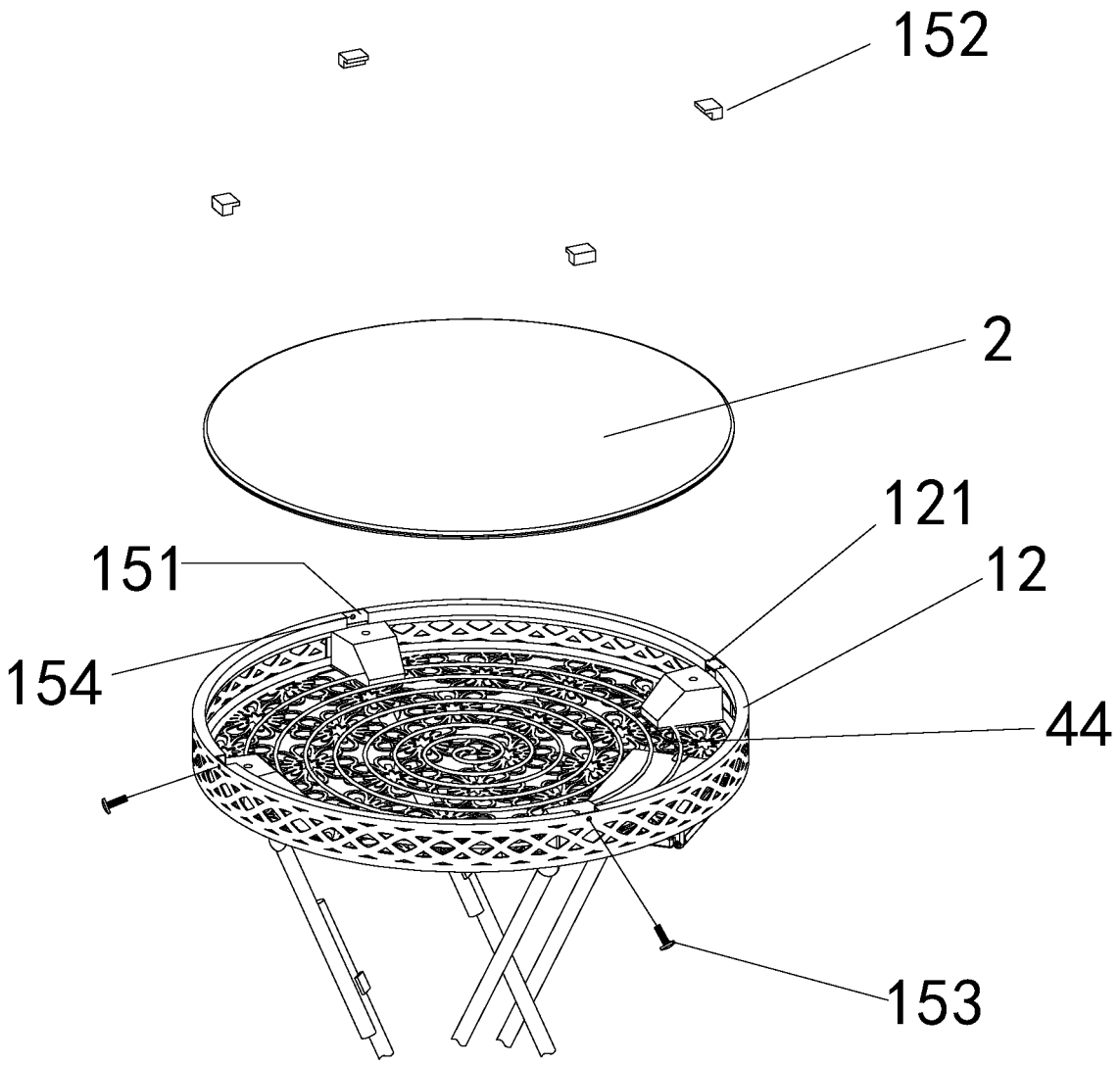
FIG. 3 is a schematic exploded structural view of embodiment 3 of the present invention.
Figure 4:
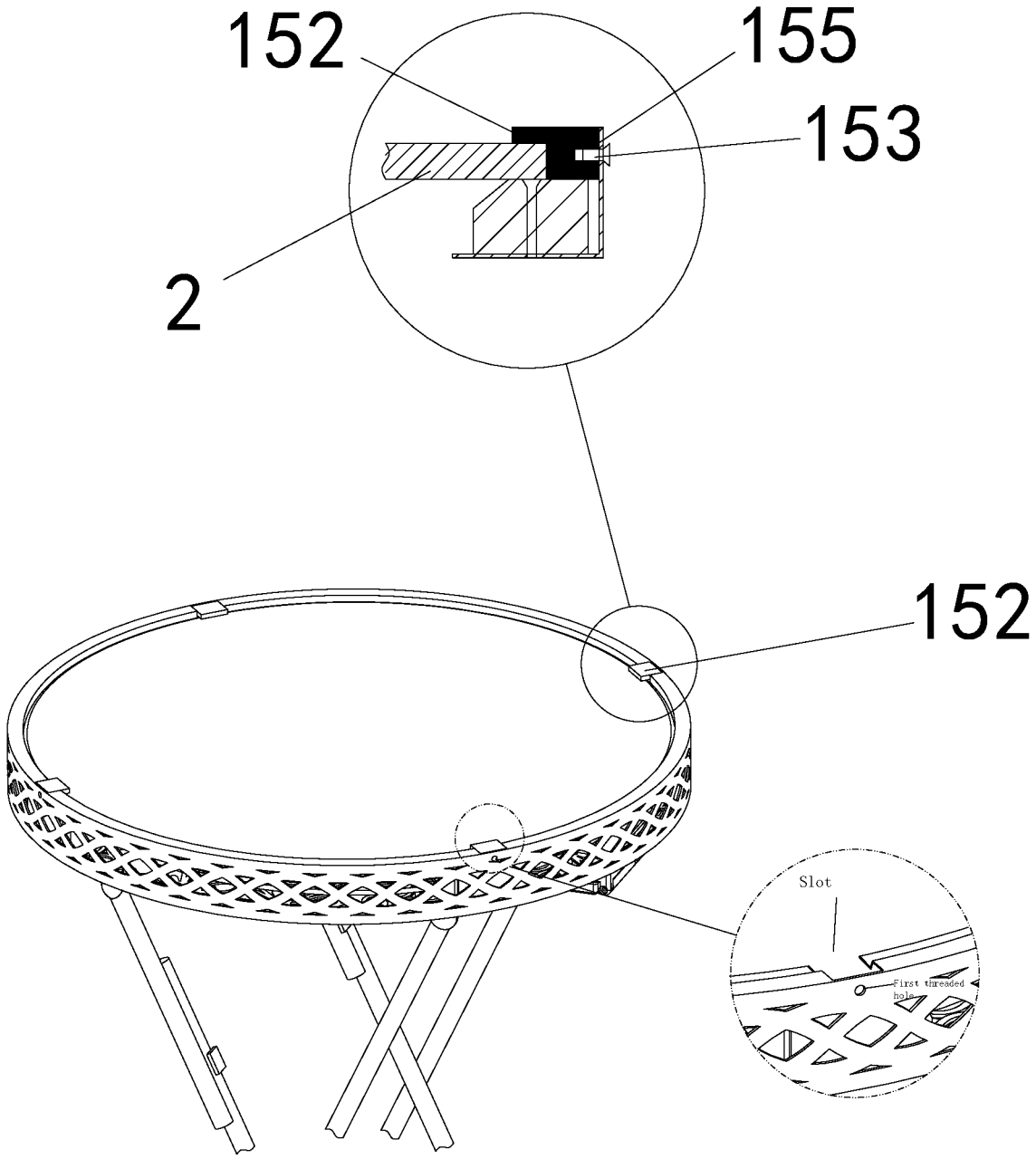
FIG. 4 is a schematic structural view of embodiment 3 of the present invention.

As shown in FIGS. 3-4, a light-emitting desk or stool is provided. Embodiment 3 is different from embodiment 2 with respect to the connection between the glass cover 2 and the hollowed side board 12. In the present embodiment, the glass cover 2 is fixed to the light-emitting hollowed box via fastening components.

A mounting platform 121 is provided on the hollowed side board 12 by an increased wall thickness at an upper part of the hollowed side board 12, or by an horizontal extension of the hollowed side board 12 inward with respect to the upper periphery of the hollowed side board 12 wherein an inner periphery of the horizontal extension is first bent downwardly, and then bent to extend horizontally again but to a direction opposite to the direction the horizontal extension extends at the upper periphery of the hollowed side board 12 so as to form a hollow mounting structure. Slots 151 are provided evenly on the mounting platform along a circumferential direction of the mounting platform. The slots 151 run through the upper periphery of the hollowed side board 12. An outer side wall of the hollowed side board 12 is provided with first threaded holes 154 at positions corresponding to the slots 151 for screws 153 to screw in. The slots 151 are fitted with fasteners 152 respectively. Each of the fasteners 151 comprises a press portion and a lock portion perpendicular to each other; the press portion presses tightly against a periphery of an upper surface of the glass cover 2; the lock portion locks with the hollowed side board 12. A shape and size of the lock portion of each of the fasteners 152 match with a corresponding slot 151; a second threaded hole 155 that also allows a corresponding screw 153 to screw in is provide on the lock portion of each of the fasteners 152 at a co-axial position that corresponds to a corresponding first threaded hole 154. The first threaded holes 154 and the second threaded holes 155 run along a radial direction of the glass cover 2.

When fixing the glass cover 2, the glass cover 2 is stably supported on the support blocks 15; a distance between top surfaces of the support blocks 15 and the upper periphery of the hollowed side board 12 is equal to a sum of a thickness of the glass cover 2 and a thickness of the press portion of each of the fasteners 152; the lock portion of each of the fasteners 152 is mounted into a corresponding slot 151, while the press portion of each of the fasteners 152 presses against the periphery of the upper surface of the glass cover 2, then the screws 153 are each inserted into a corresponding first threaded hole 154 and a corresponding second threaded hole 155, and eventually the fasteners 152 are fastened to the hollowed side board 12. Accordingly, an upper surface of the press portion of each of the fasteners 152 aligns with the upper periphery of the hollowed side board 12.

In view of the above, the glass cover 2 will not get loose after installation. Also, the mounting positions between the glass cover 2 and the hollowed side board 12 are neat, and the glass cover and the hollowed side board can be easily dismounted and replaced.

Figure 14:
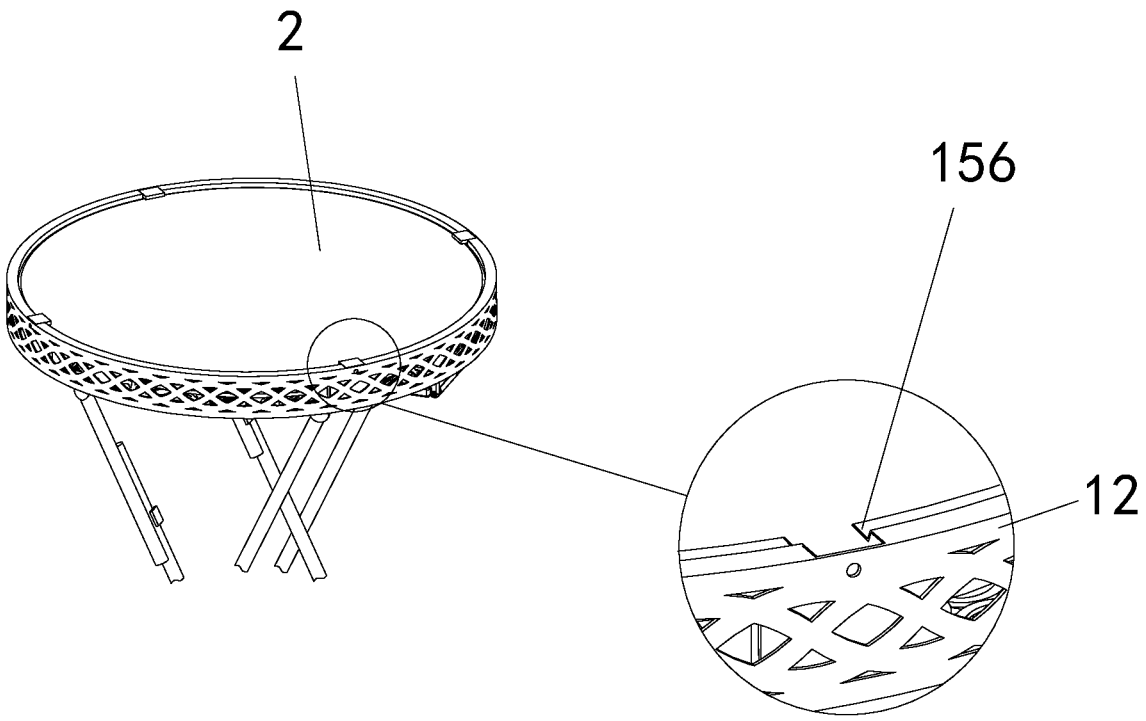
FIG. 14 is another schematic structural view of the embodiment 3 of the present invention.

According to another preferred embodiment as shown in FIG. 14, the horizontal extension of the hollowed side board 12 inward with respect to the upper periphery of the hollowed side board 12 is also provided with a step 156 to support the glass cover 2. During installation, a position of the glass cover 2 is limited by the step 156 so as to obtain a stable installed structure.

Embodiment 4

Figure 5:
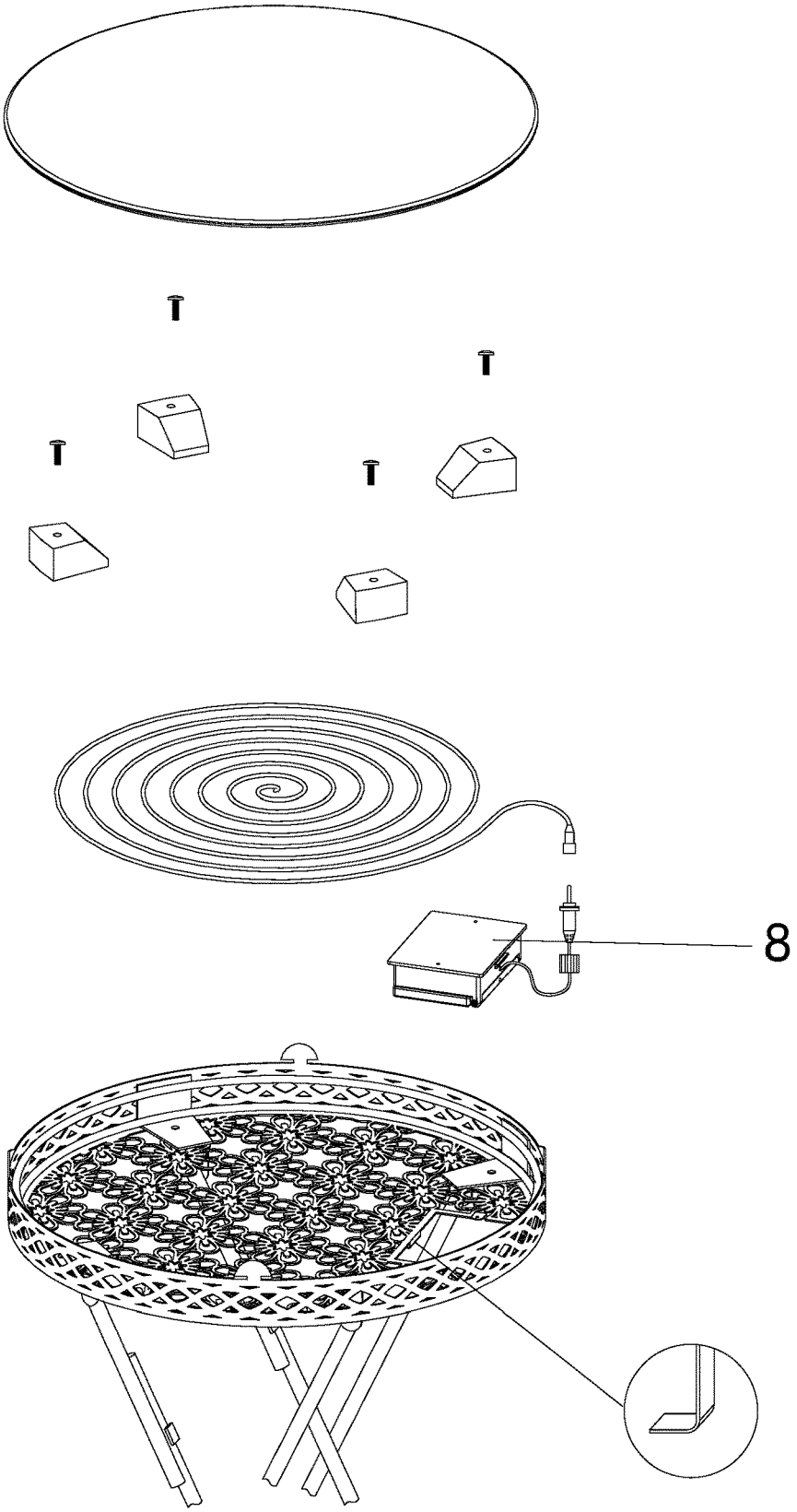
FIG. 5 is a schematic exploded structural view of embodiment 4 of the present invention.
Figure 6:
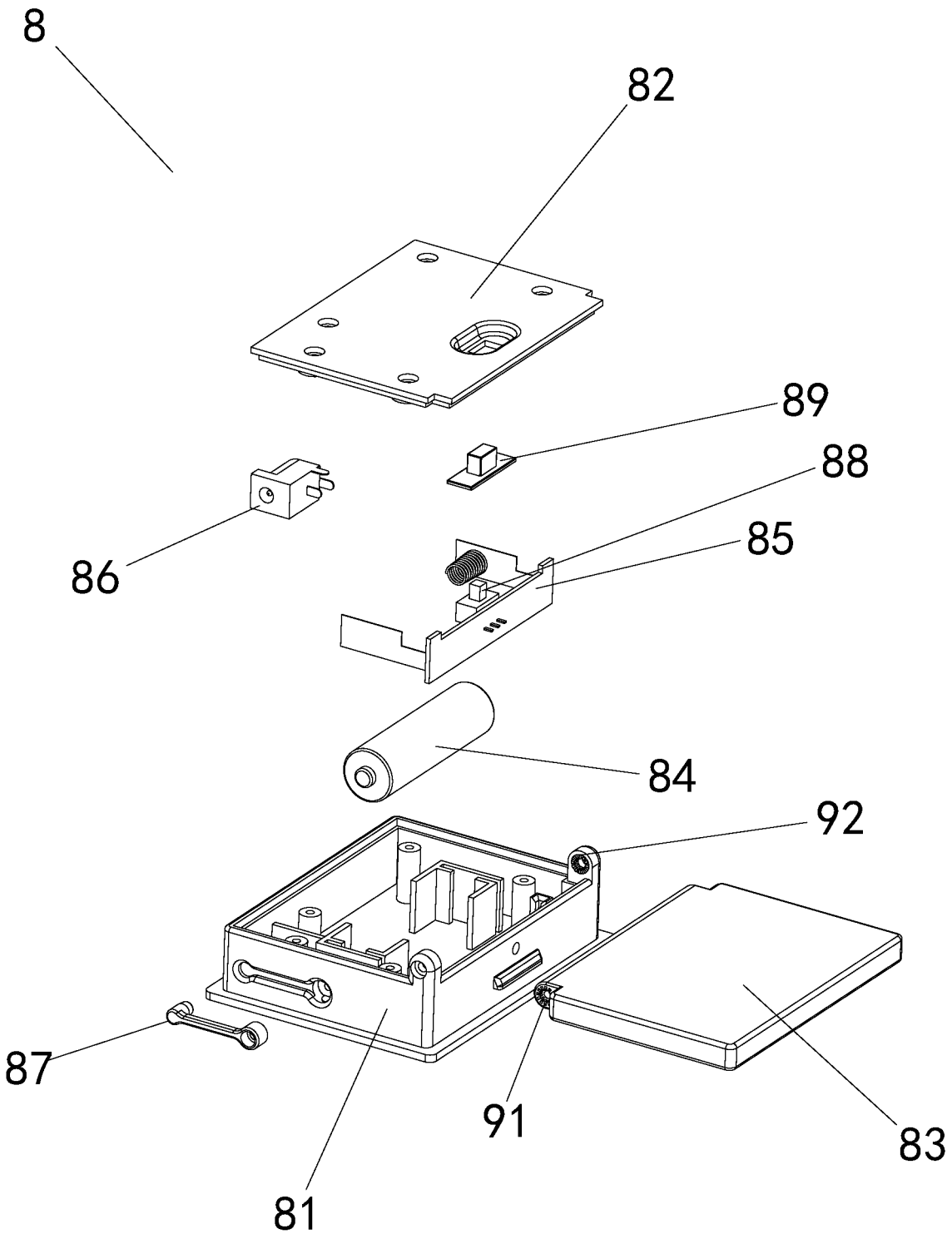
FIG. 6 is a schematic exploded structural view of the battery box of embodiment 4 of the present invention.

As shown in FIGS. 5-6, a light-emitting desk or stool is provided.

Embodiment 4 is different from embodiment 3 with respect to the solar power assembly. In the present embodiment, the solar power assembly uses a battery box 8; the battery box 8 comprises a battery box body and a solar panel; the battery box body comprises a solar panel frame 83, and a battery box shell 81 and the battery box cover 82 connected together by screws; the solar panel frame 83 is disposed above the battery box cover 82 and is capable of being flipped open with respect to the battery box cover 82 (the solar panel frame 83 is flipped upward, in other words, when the solar panel frame is flipped open, it forms an angle with the horizontal level; when the solar panel frame is not flipped open, it is parallel to the horizontal level); the solar panel frame 83 and the battery box shell 81 are rotatably connected. A base board of the battery box shell 81 is fixed on the hollowed base board 11 near to a periphery of the hollowed base board 11. The solar panel frame 83 can be rotated towards a direction away from the base board of the battery shell 81. A solar panel is fixed on the solar panel frame 83. During charging, the solar panel is rotated and unfolded to a direction facing to the sun to absorb sunlight. When not in use, the solar panel is folded and stored. It should be noted that, the solar panel frame 83 may also be flipped opened horizontally so that the solar panel frame can flip leftward and rightward. Also, the battery box body may be fixed to a side board of the hollowed cover or a side board of the mounting seat according to practical situation.

Components like a storage battery 84 and a PCB (printed circuit board) 85 are disposed inside the battery box shell 81; a side wall of the battery box shell 81 is provided with a DC plug or a DC port 86; the DC plug or the DC port 86 is provided with a water-proof stopper 87. A control circuit of power output and recharge is electrically connected to the storage battery 84 and the PCB 85 bidirectionally; the DC plug or the DC port 86 is electrically connected to an input end of this control circuit, and the solar panel is connected to an input end of this control circuit. An output end of this control circuit is electrically connected to the LED strip lights 3 via a control button 88. The control button 88 is disposed at a hole on the battery box cover 82 for easier operation. The control button 88 is sleeved with a control button water-proof cap 89.

Further, two ends of the solar power panel 83 connecting to the battery box shell 81 are each provided with an inwardly recessed gear 91; two arms of the battery box shell 81 connecting with the solar panel frame 83 are each provided with a corresponding protruded gear 92. The inwardly recessed gear 91 and the protruded gear 92 are correspondingly disposed, and a bolt is used to pass through the inwardly recessed gear and the protruded gear so that the inwardly recessed gear and the protruded gear are fixed in position at the battery box shell 81; the bolt serves the function of a rotational shaft. Rotary cooperation is formed between the inwardly recessed gear 91 and the protruded gear 92.

Figure 10:
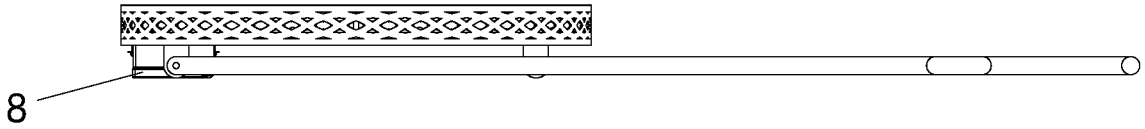
FIG. 10 is a schematic structural view of the foldable frame of embodiment 4 of the present invention in a folded condition.

Further, when the solar panel frame 83 is completely folded on the battery box cover 82, and the foldable frame is also completed folded, as shown in FIG. 10, the battery box 8 aligns substantially with an outer side of the foldable frame so as to reduce the space being occupied.

Embodiment 5

Figure 7:
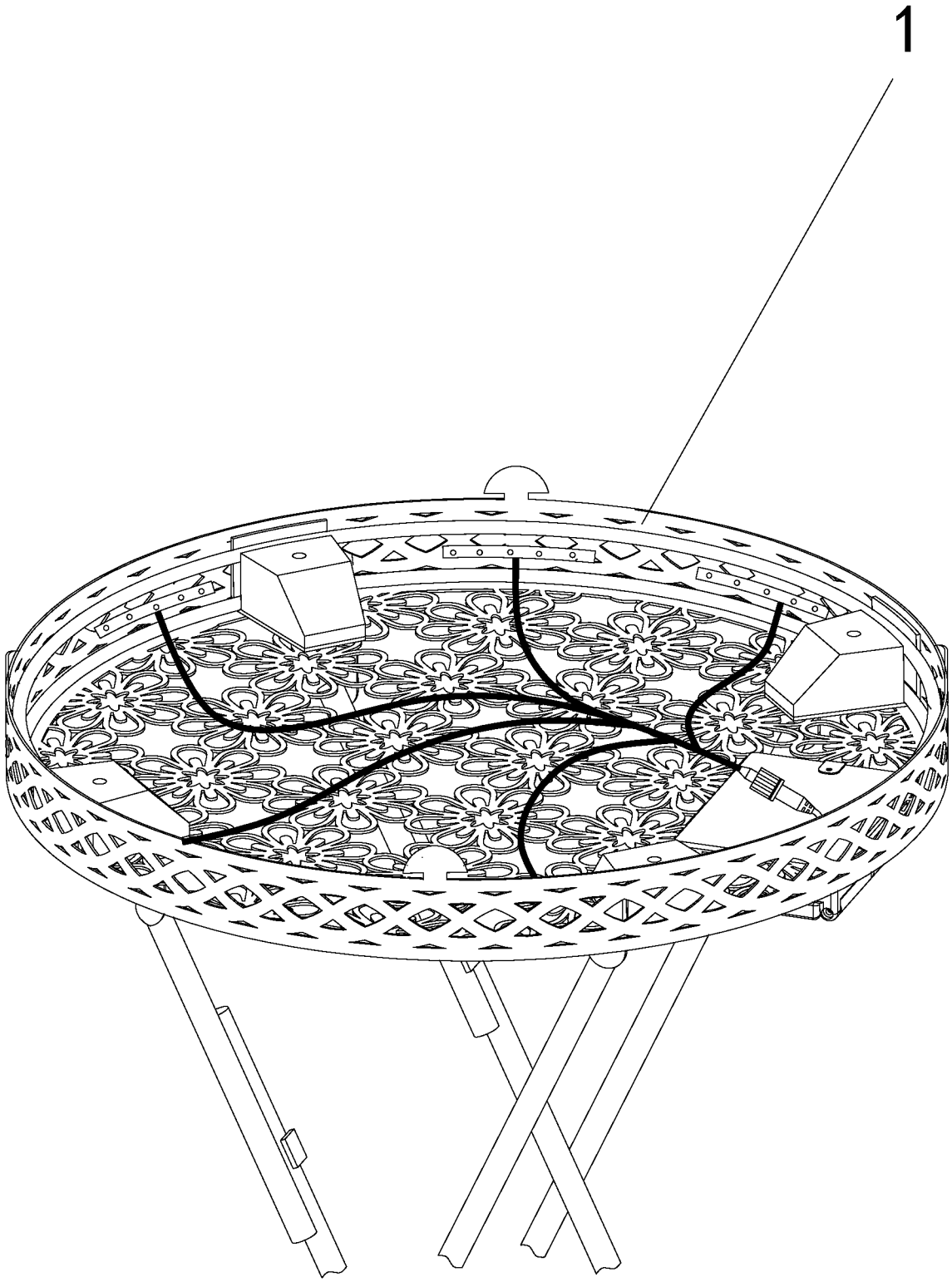
FIG. 7 is a schematic structural view of embodiment 5 of the present invention.

As shown in FIG. 7, a light-emitting desk or stool is provided. Embodiment 5 is different from embodiment 2 with respect to the light-emitting bodies and their positions. In the present embodiment, the light-emitting bodies are disposed on an inner surface of a side board of the mounting seat 1.

Embodiment 6

Figure 8:
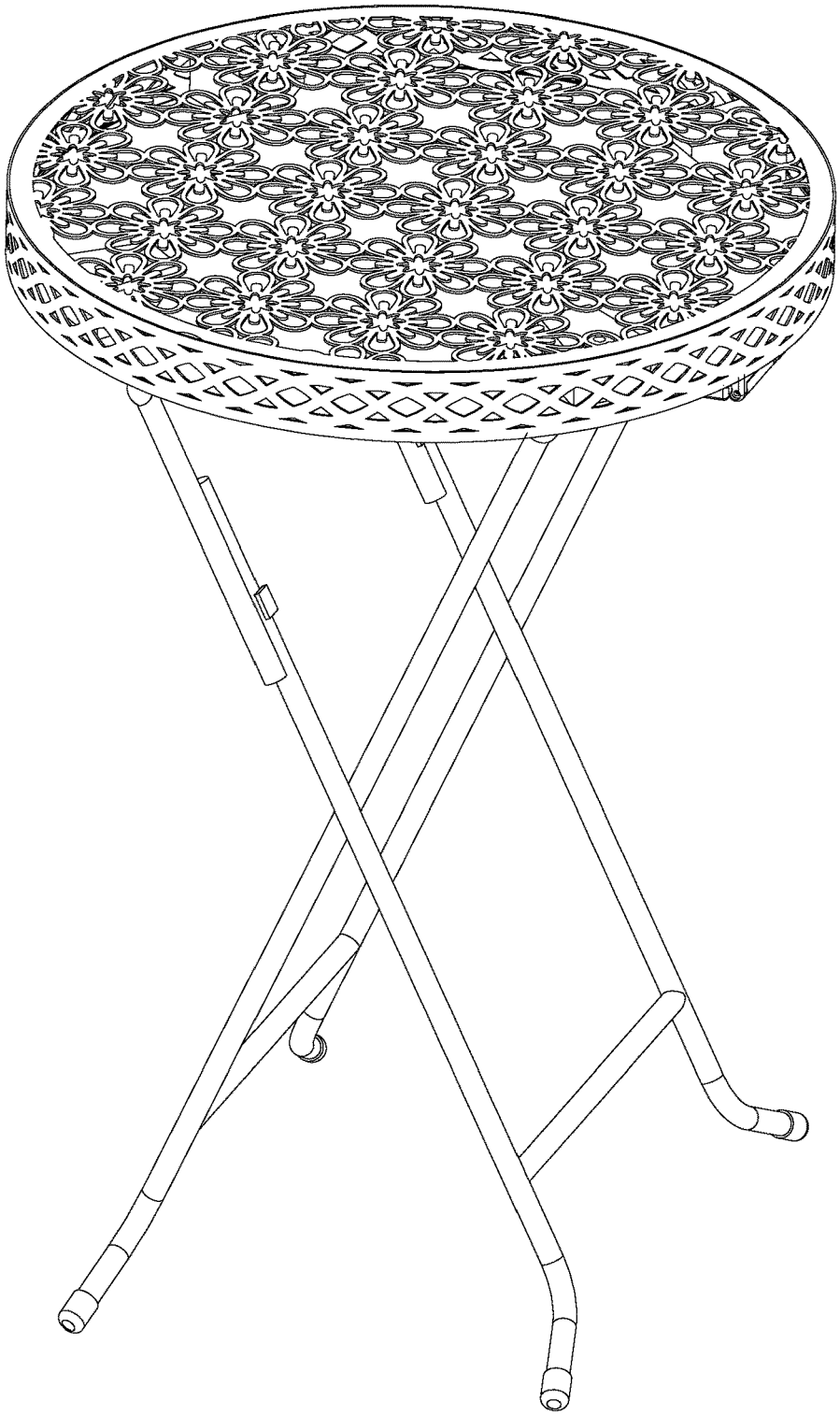
FIG. 8 is a schematic structural view of embodiment 6 of the present invention.

As shown in FIG. 8, a light-emitting desk or stool is provided. Embodiment 6 is different from embodiment 1 in that: the transparent cover according to the present embodiment is a hollowed cover. The base board and the side board of the light-emitting hollowed box are hollowed based board and hollowed side board respectively.

Embodiment 7

Figure 9:
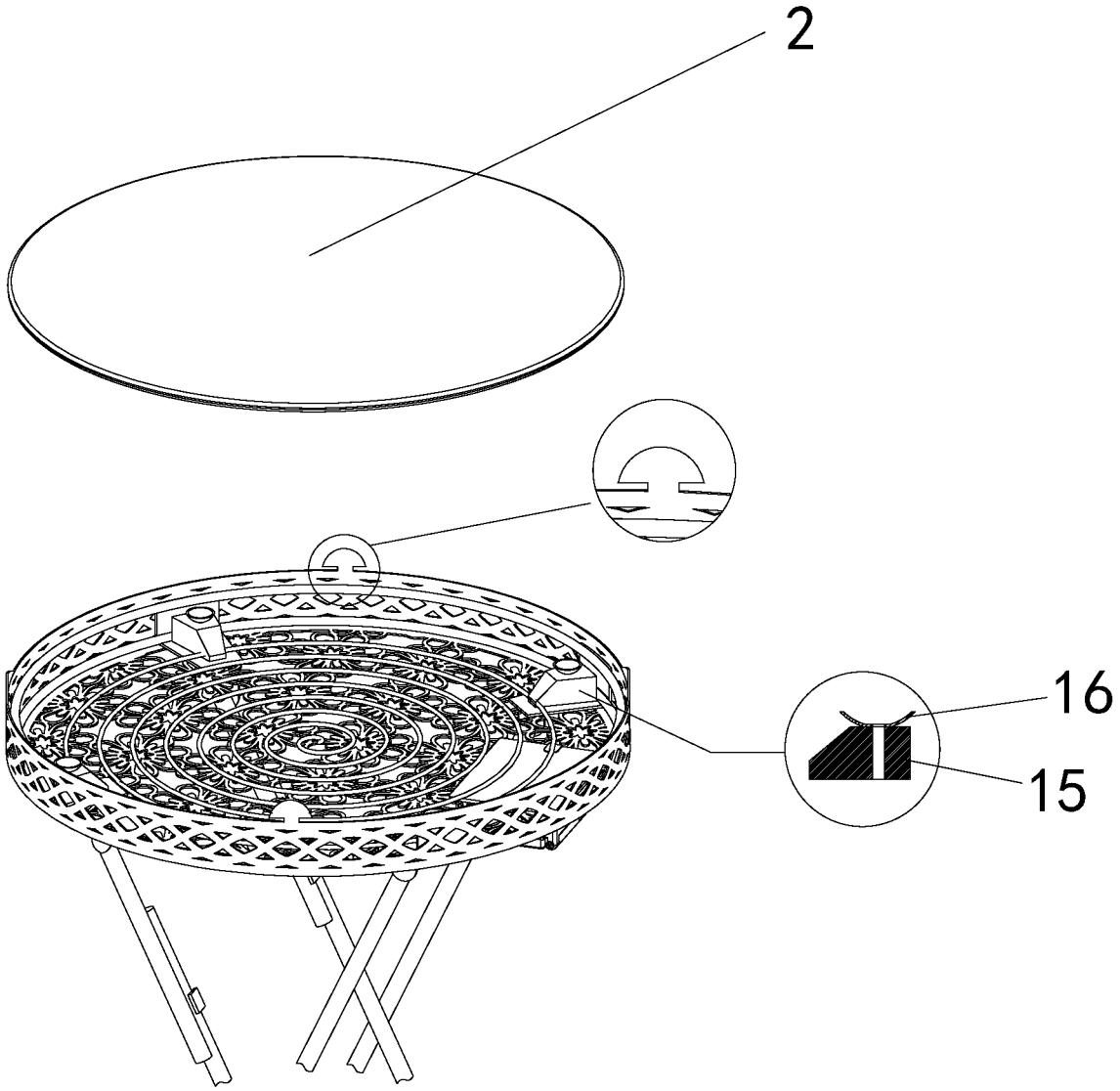
FIG. 9 is a schematic structural view of embodiment 7 of the present invention.

As shown in FIG. 9, a light-emitting desk or stool is provided. Embodiment 7 is different from embodiment 2 in that: according to the present embodiment, an anti-shock gasket 16 is provided between each of the support blocks 15 and the glass cover 2. The anti-shock gasket 16 can reduce shock to prevent breakage of the glass cover 2. The support blocks 15 are preferably made by plastic material.

It should be noted that, structures (especially the contact part with the glass cover) and positions of the anti-shock gasket are preferably designed not to obstruct the lights to illuminate out of the hollowed portions to project the entire pattern defined by the hollowed portions.

Embodiment 8

Figure 11:
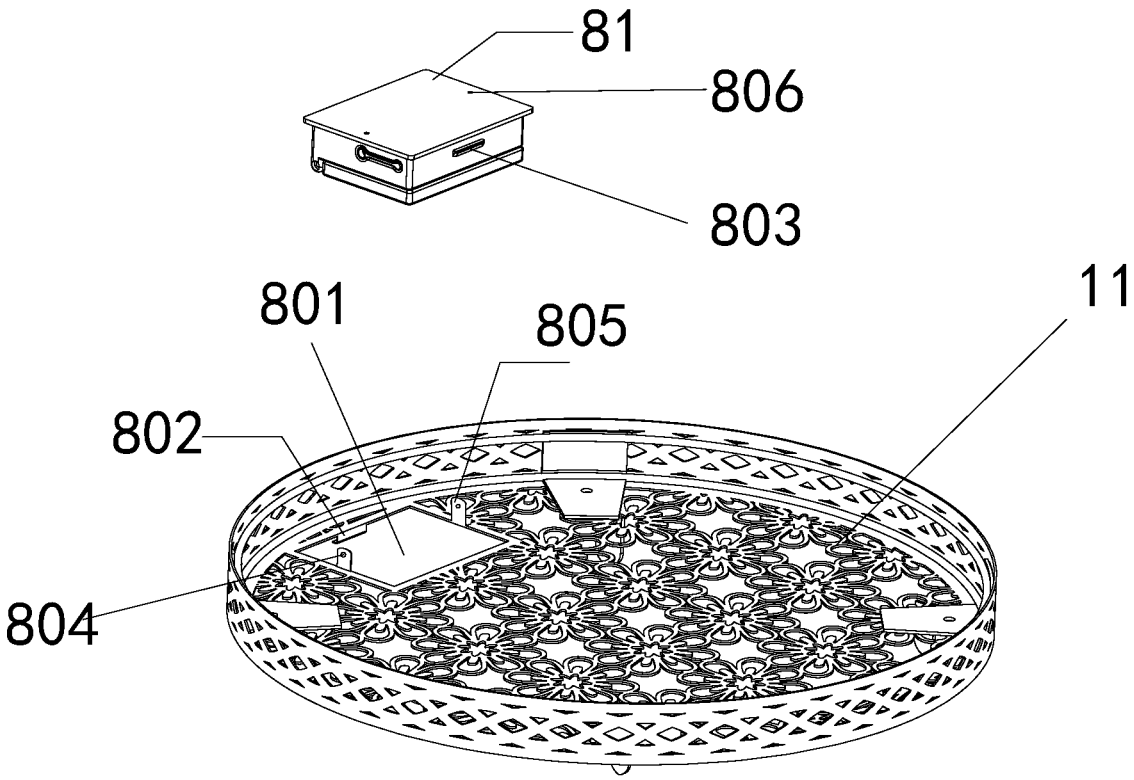
FIG. 11 is a schematic exploded structural view of the battery box shell and the hollowed base board according to embodiment 8 of the present invention.
Figure 12:
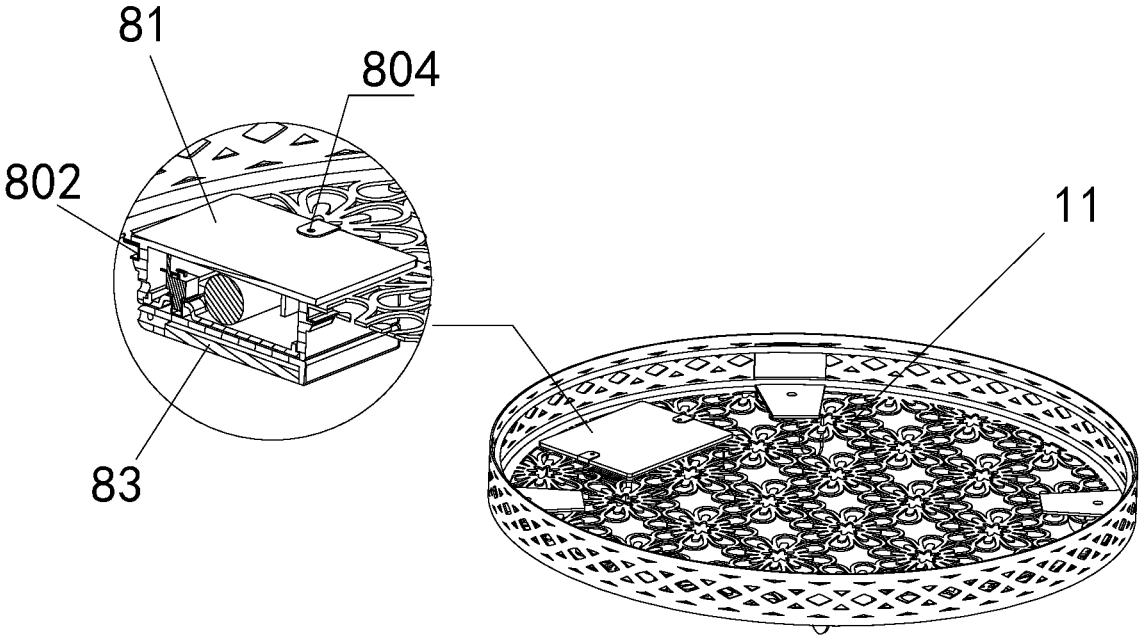
FIG. 12 is a schematic view showing the battery box shell installed to the hollowed base board according to embodiment 8 of the present invention.

The embodiment illustrated in FIGS. 11-12 is different from embodiment 4 with respect to the connection between the battery box shell 81 and the hollowed base board 11. In the present invention, an installation hole 801 that matches the shape and size of the battery box shell 81 is provided at the hollowed base board 11 near a periphery thereof; a pair of buckles 802 are disposed at two opposed edges of the installation hole 801 respectively, and the buckles 802 extend downwardly from the edges of the installation hole 801. Correspondingly, grooves 803 are provided on the battery box shell 81 corresponding to the buckles 802. The grooves 803 and the buckles 802 cooperate with one another.

A pair of tightening strips 805 are provided at two other opposed edges of the installation hole 801 respectively, and the tightening strips 805 extend upwardly from the edges of the installation hole 801. The tightening strips 805 can be bent. Each of the tightening strips 805 is provided with a first screw hole 804. Corresponding, second screw holes 806 corresponding to each of the first screw holes 804 provided on the tightening strips are provided on the base board of the battery box shell 81.

During installation, the battery box shell 81 (the solar panel frame 83 facing downwardly) is installed in the installation hole 801, and the buckles 802 buckle to the grooves 803. The solar panel frame 83 passes through downwardly through the installation hole 801, and is positioned below the hollowed base board 11. Next, the tightening strips 805 are bent to attach to the base board of the battery box shell 81 so that the first screw holes 804 align with the second screw holes 806, and screws are then used to pass through the first screw holes 804 and the second screw holes 806 so as to fix the tightening strips 805 with the battery box shell 81.

The battery box shell 81 is obscured when it is attached to the hollowed base board 11 via the installation hole 801. Therefore, the present invention is easy to install and has a more pleasant outer appearance. The installation hole 801 is provided near to the periphery of the hollowed base board 11 so that the solar panel frame 83 can be easily unfolded to extend out of the periphery of the hollowed base board 11 to absorb sunlight, and can be easily folded for storage.

Embodiment 9

The present invention describes a specific arrangement of the LED strip lights.

Figure 13:
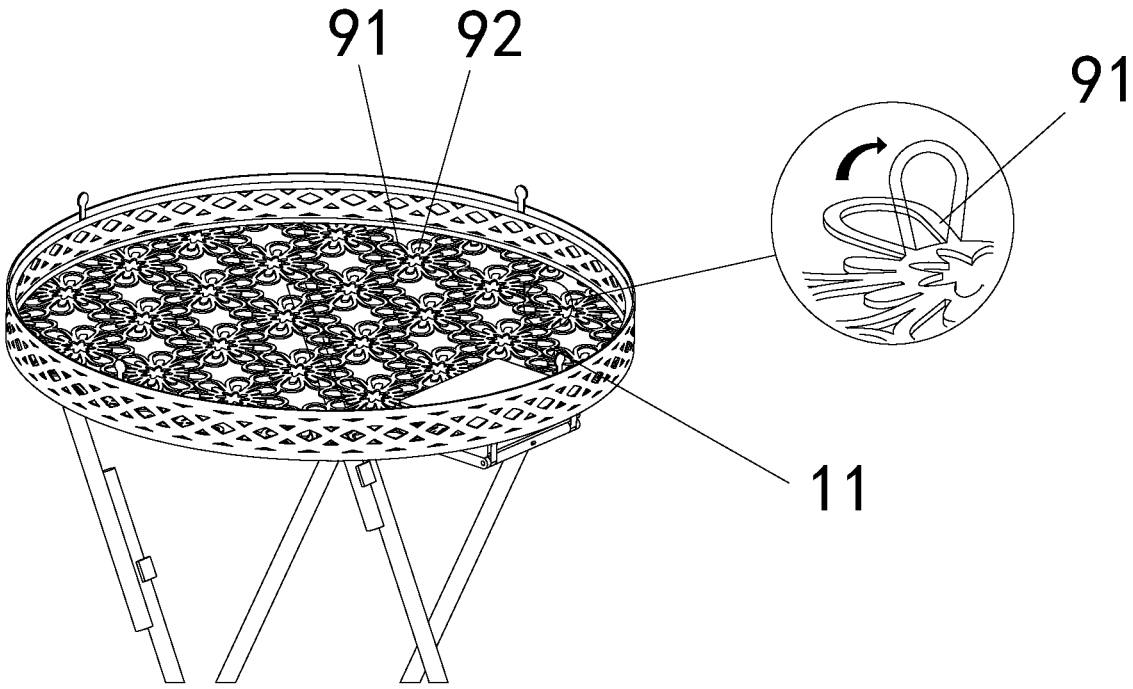
FIG. 13 is a schematic structural view of embodiment 9 of the present invention.

As shown in FIG. 13, a second preferred embodiment of arranging the LED strip lights is disclosed, wherein the hollowed base board 11 comprises a plurality of flower-shape units containing hollowed portions. Hollowed portions are also formed between the flower-shape units. In the present invention, each of the flower-shape units comprises a plurality of petals. The hollowed portions are formed within each of the plurality of petals such that each of the petals is divided into an outer petal 91 and an inner petal 92; preferably, the outer petal and the inner petal of each petals are correspondingly configured. The outer petal is either a free petal or a connecting petal; in case of being the connecting petal, it is used to connect with other adjacent connecting petals of other petals, therefore the flower-shaped units are connected together via the connecting petals. Free petals or inner petals 92 can be bent upwardly to form fixing aids to fix the LED strip lights. In other words, the fixing aids are formed by bending up some parts of the hollowed base board 11.

It should be noted that, the base board or the side board can be punched to form foldable fixing aids according to practical situation, and the base board and the side board can also form punch holes thereon according to practical situation. The punch holes can be used with locking components that can fix the LED strip lights.

Embodiment 10

The present invention describes a specific arrangement of the LED strip lights.

FIG. 1 also illustrates a third preferred embodiment of arranging the LED strip lights. A fixing aid 4 that facilitates arrangement of the LED strip lights 3 is arranged on the inner surface of the hollowed base board 11. Preferably, the fixing aid 4 is provided with fixing rings 41 spaced with one another for the LED strip lights to pass through. Preferably, the fixing aid 4 comprises rods; the rods comprise a lateral rod 43 and a longitudinal rod 42 crossing each other perpendicularly and running along a diameter of the hollowed base board 11. The LED strip lights 3 can directly wind around the lateral rod 43 and the longitudinal rod 42.

Preferably, the lateral rod 43 and the longitudinal rod 42 are provided with fixing rings 41 evenly distributed with respect to one another. A quantity of the fixing rings 41 on the lateral rod 43 is the same as a quantity of the fixing rings 41 on the longitudinal rod 42. Also, spacing distances between every two adjacent fixing rings 41 are the same. The fixing rings 41 on the lateral rod 43 each having an axial direction along the same direction as the longitudinal rod 42, and are symmetrically distributed along the lateral rod 43 having the longitudinal rod 42 being an axis of symmetry. Likewise, the fixing rings 41 on the longitudinal rod 42 each having an axial direction along the same direction as the lateral rod 43, and are symmetrically distributed along the longitudinal rod 42 having the lateral rod 43 being an axis of symmetry. As such, when an LED strip light passes through four fixing rings 41 having the same distance from a center of the hollowed base board 11, the LED strip light forms a circular ring shape. Different groups of four fixing rings, with the four fixing rings in each group having the same distance from the center of the hollowed base board 11, but with such distance different among different groups, allow different LED strip lights each passing through each respective group of four fixing rings. Therefore, all LED strip lights being arranged define different concentric circles. In the present invention, there are three LED strip lights having three different diameters respectively, and are arranged to define concentric circles with respect to the center of the hollowed base board 11. The hollowed side board 2 is provided with hollowed portions for light permeation. All the hollowed portions together define a pattern. The lights emitted by the LED strip lights 3 illuminate from inside to outside of the hollowed side board 2 through the hollowed portions. It should be noted that, the positions of the LED strip lights 3 of the present invention can be arranged according to practical need, given that the requirements for lighting and/or aesthetic effects can be fulfilled. Also, the lights emitted by the LED strip lights 3 also illuminate through the glass cover 2, as well as through the hollowed portions of the hollowed side board 12. As such, the pattern defined by the hollowed portions is projected onto the wall. Therefore, a good visual effect is achieved in that not only lighting is provided, but a pattern is generated for visual appreciation.

According to a fourth preferred embodiment of arranging the LED strip lights, the fixing aid 4 comprises a group of concentric circular rings; the LED strip lights are each being wound around a respective concentric circular ring to define a plurality of concentric circular light rings.

The embodiments as described and the figures as illustrated are not intended to limit the form and configuration of the present invention. Any appropriate changes or modifications made by any person skilled in this field of art should also fall within the scope of the present invention.

What is claimed is:

1. A light-emitting desk or stool, comprising a frame and a support portion mounted on the frame; wherein the support portion is a hollowed light-emitting box, comprising a mounting seat and a transparent cover mounted on the mounting seat; a cavity is formed between the mounting seat and the transparent cover; light-emitting bodies are provided within the cavity; lights emitted by the light-emitting bodies pass through hollowed portions provided on the mounting seat.

2. The light-emitting desk or stool of claim 1, wherein the mounting seat comprises a base board and a side board connected to a periphery of the base board enclosing the base board, wherein the base board and/or the side board is a hollowed base board and a hollowed side board respectively; the hollowed portions that allow light permeation are provided on the hollowed base board and the hollowed side board; the transparent cover is a glass cover, or the transparent cover is a hollowed cover having hollowed portions; the light-emitting bodies are light strips; the light strips are mounted to an inner surface of the base board, and/or to an inner surface of the side board.

3. The light-emitting desk or stool of claim 2, wherein the light strips are mounted to the inner surface of the base board; a fixing aid is provided on the inner surface of the base board to facilitate arrangement of the light strips.

4. The light-emitting desk or stool of claim 3, wherein the fixing aid is a fixing disc having a spiral shape, or the fixing aid comprises a group of concentric circular rings, or the fixing aid comprises rods, or the fixing aid comprises parts of the base board being bended up.

5. The light-emitting desk or stool of claim 2, wherein the hollowed light-emitting box is provided with a power source module to provide working power for the light strips; the power source module is a solar power assembly; the solar power assembly comprises a solar panel movably adjustable in position to be unfolded to a position below sunlight to absorb the sunlight, and also capable of being folded for storage.

6. The light-emitting desk or stool of claim 5, wherein the solar power assembly uses a battery box; the battery box comprises a battery box body and the solar panel; the solar panel is disposed on the battery box body;

the battery box body is fixed to the side board of the mounting seat, or fixed to the transparent cover, or fixed to the base board of the mounting seat near to the periphery of the base board.

7. The light-emitting desk or stool of claim 6, wherein the battery box body comprises a battery box shell; a storage battery and a control circuit that controls power output and recharge are disposed inside the battery box shell; a side wall of the battery box shell is provided with a DC plug or a DC port; the DC plug or the DC port is provided with a water-proof stopper; the storage battery and the control circuit are electrically connected to each other bidirectionally; the DC plug or the DC port is electrically connected to an input end of the control circuit, and the solar panel is connected to the input end of the control circuit; an output end of the control circuit is electrically connected to the light strips via a control button; the control button is sleeved with a control button water-proof cap.

8. The light-emitting desk or stool of claim 2, wherein support blocks are provided on the base board around the periphery of the base board to support the transparent cover; the transparent cover is directly supported on the support blocks, or the transparent cover is supported on the support blocks while anti-shock gasket is provided between each of the support blocks and the transparent cover.

9. The light-emitting desk or stool of claim 8, wherein the transparent cover is fixed to the hollowed light-emitting box via fastening components; slots are provided at an upper part of the hollowed side board; the slots run through an upper periphery of the hollowed side board; the slots are fitted with fasteners respectively; each of the fasteners comprises a press portion and a lock portion perpendicular to each other; the press portion presses tightly against a periphery of an upper surface of the transparent cover; the lock portion locks with the hollowed side board; a shape and size of the lock portion of each of the fasteners match with a corresponding slot; the lock portion of each of the fasteners is mounted into a corresponding slot.

10. The light-emitting desk or stool of claim 2, wherein the side board is the hollowed side board; both the transparent cover and the base board have a circular shape;

correspondingly, the hollowed side board has a circular ring shape; foldable fixing pieces are distributed around an upper periphery of the hollowed side board along a circumferential direction of the hollowed side board; the foldable fixing pieces are soft and durable to repeated bending; the transparent cover is fixed to the hollowed side board via the foldable fixing pieces.

11. The light-emitting desk or stool of claim 8, wherein the side board is the hollowed side board; both the transparent cover and the base board have a circular shape; correspondingly, the hollowed side board has a circular ring shape; foldable fixing pieces are distributed around an upper periphery of the hollowed side board along a circumferential direction of the hollowed side board; the foldable fixing pieces are soft and durable to repeated bending; the transparent cover is fixed to the hollowed side board via the foldable fixing pieces.

* * * * *